US005946529A

United States Patent [19]

Sato et al.

[11] Patent Number: 5,946,529

[45] Date of Patent: Aug. 31, 1999

[54] IMAGE FORMING APPARATUS USING A ROLLER TYPE CHARGING SYSTEM

[75] Inventors: Masumi Sato; Toshiyuki Uchida, both of Kanagawa; Katsumi Masuda; Masato Yokoyama, both of Tokyo; Takaya Muraishi, Kanagawa, all of Japan

[73] Assignee: Ricoh Company, Ltd., Tokyo, Japan

[21] Appl. No.: 08/953,498

[22] Filed: Oct. 17, 1997

[30] Foreign Application Priority Data

Oct. 19, 1996 [JP] Japan ..... 8-297688

[51] Int. Cl.[6] ..... G03G 15/02; G03G 21/00

[52] U.S. Cl. ..... 399/100; 399/176

[58] Field of Search ..... 399/176, 174, 399/168, 100, 98, 345, 350; 361/214, 221, 225; 15/256.5, 256.53, 256.51, 256.52

[56] References Cited

U.S. PATENT DOCUMENTS

| | | | |
|---|---|---|---|
| 4,334,766 | 6/1982 | Sugiyama et al. | 399/351 |
| 4,595,280 | 6/1986 | Tanzawa et al. | 399/345 |
| 5,349,426 | 9/1994 | Kudoh et al. | 399/350 |
| 5,443,873 | 8/1995 | Itani et al. | 399/176 X |
| 5,467,174 | 11/1995 | Koga | 399/176 X |
| 5,557,373 | 9/1996 | Miyashita et al. | 399/176 X |
| 5,742,880 | 4/1998 | Takenaka et al. | 399/176 |

FOREIGN PATENT DOCUMENTS

| | | |
|---|---|---|
| 1-191161 | 8/1989 | Japan . |
| 2-272594 | 11/1990 | Japan . |
| 3-59563 | 3/1991 | Japan . |
| 5-173400 | 7/1993 | Japan . |
| 5-265307 | 10/1993 | Japan . |
| 6-3930 | 1/1994 | Japan . |
| 7-168422 | 7/1995 | Japan . |
| 7-175298 | 7/1995 | Japan . |
| 7-199604 | 8/1995 | Japan . |
| 5-281502 | 10/1995 | Japan . |
| 8-6359 | 1/1996 | Japan . |
| 8-44159 | 2/1996 | Japan . |
| 8-62948 | 3/1996 | Japan . |

OTHER PUBLICATIONS

English Abstract of Japanese 2–272589 entitled "Image Forming Device", Nov. 7, 1990.

*Primary Examiner*—Sandra Brase
*Assistant Examiner*—Sophia S. Chen
*Attorney, Agent, or Firm*—McDermott, Will & Emery

[57] ABSTRACT

An image forming apparatus of the present invention includes a charging device made up of a charge roller and a roller cleaning member for cleaning the charge roller. The charge roller is held in contact with a photoconductive element and uniformly charges the element while being driven by the element. The roller cleaning member is held in contact with the charge roller in order to remove impurities from the roller. The charge roller has a resistance ranging from $1\times10^3\Omega$ to $1\times10^7\Omega$. The cleaning device exhibits a stable charging ability over a long time of use without resorting to a mechanism for moving the charge roller into and out of contact with the photoconductive element or for moving the roller cleaning member into and out of contact with the charge roller.

12 Claims, 3 Drawing Sheets

IMAGE FORMING APPARATUS USING A ROLLER TYPE CHARGING SYSTEM

BACKGROUND OF THE INVENTION

The present invention relates to an electrophotographic image forming apparatus using a roller type charging system including a charge roller driven by a photoconductive element while contacting at least the image forming region of the element and applied with a DC constant voltage for uniformly charging the element, and roller cleaning means contacting the charge roller for removing toner and other impurities from the roller.

A roller type or contact type charging device including a charge roller contacting and driven by a photoconductive element for uniformly charging the element is extensively used in a copier, printer, facsimile apparatus or similar image forming apparatus. An electrophotographic image forming apparatus executes an electrophotographic process consisting of charging, exposure (optical writing), development, image transfer, paper separation, cleaning, and discharging. After the transfer of a toner image from the photoconductive element to a paper, toner left on the element is removed by a cleaning device together with paper dust and other impurities. Therefore, if the photoconductive element is completely cleaned by the cleaning device, theoretically no impurities including toner and paper dust will remain on the surface of the charge roller contacting the element. In practice, however, it is difficult to remove all the impurities from the surface of the photoconductive element. Should the impurities deposit on the charge roller, they would bring about irregular charging.

In light of the above, Japanese Patent Laid-Open Publication No. 2-272594, for example, teaches a cleaning arrangement wherein a sponge member is pressed against a charge roller for cleaning the roller. Japanese Patent Laid-Open Publication No. 5-265307, for example, discloses a cleaning arrangement wherein a cleaning member for cleaning a charge roller is slidable in the lengthwise direction of the roller.

However, the condition for maintaining the cleaning member in contact with the charge roller is delicate. Excessively weak contact would cause the cleaning effect to be practically lost. On the other hand, excessively strong contact would cause the surface of the charge roller to wear and reduce the life of the cleaning member. Assume that the cleaning member is constantly held in contact with the charge roller. Then, even if the above contact condition is adequate, filming occurs on the surface of the charge roller and lowers charge potential.

In order to obviate filming, an arrangement may be made such that the charge roller is movable into and out of contact with the photoconductive element or the cleaning member is movable into and out of contact with the charge roller, as taught in, e.g., Japanese Patent Laid-Open Publication No. 6-3930. In this arrangement, cleaning is effected as a part of a mechanical operation. This kind of scheme, however, needs a sophisticated mechanism and increases the cost of the apparatus.

SUMMARY OF THE INVENTION

It is therefore an object of the present invention to provide an image forming apparatus using a roller type charging system including a charging device capable of exhibiting a stable charging ability over a long period of time without resorting to any sophisticated mechanism, thereby ensuring high image quality.

An image forming apparatus using a roller type charging system of the present invention includes a charge roller rotated by a photoconductive element while contacting at least the image forming region of the element, and applied with a DC constant voltage for uniformly charging the element. A roller cleaning member contacts the charge roller for removing impurities, including toner, from the surface of the roller. The charge roller has a resistance ranging from $1\times10^3\Omega$ to $1\times10^7\Omega$.

In a preferred embodiment, use is made of toner containing a 1 wt % of additive.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
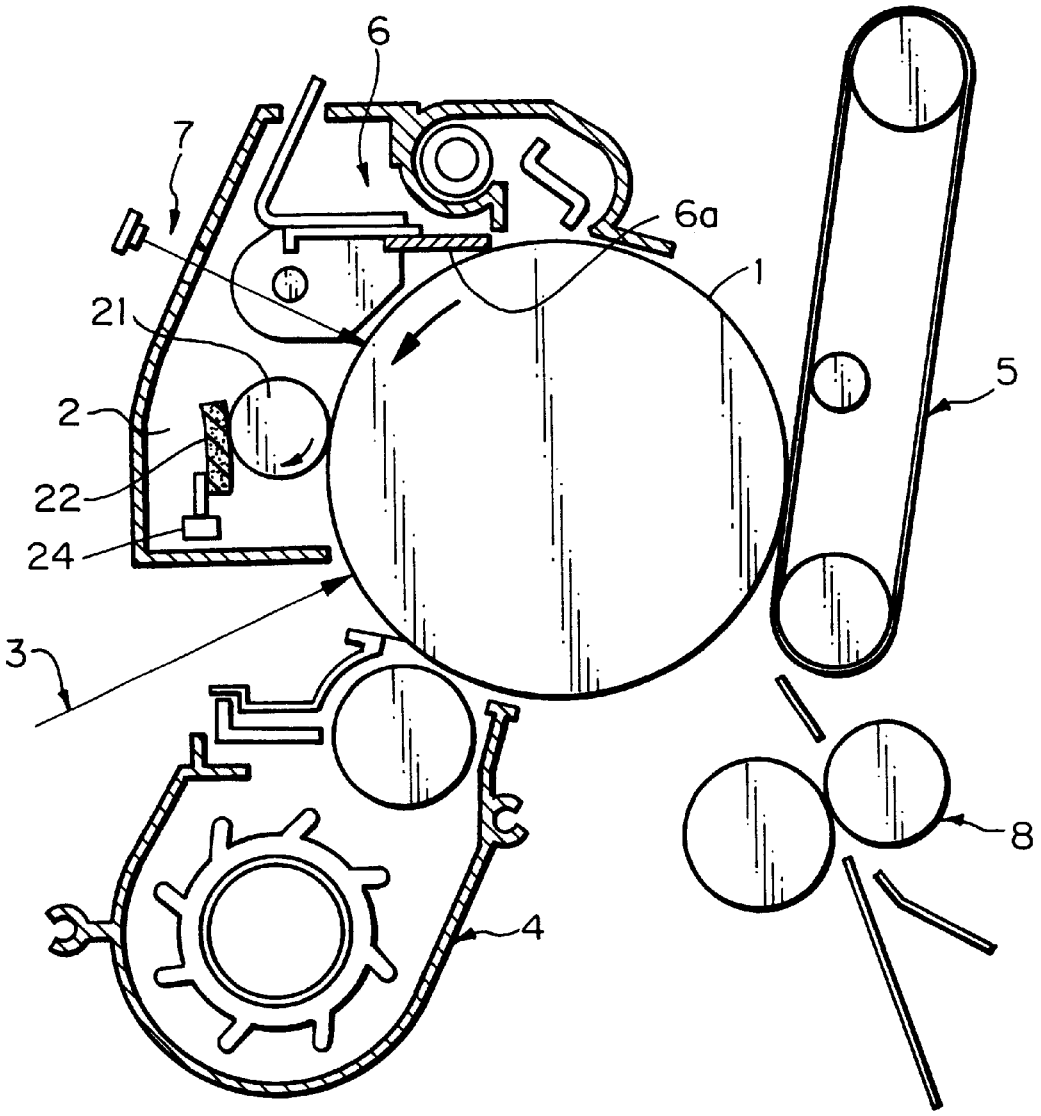
FIG. 1 is a fragmentary view showing an image forming apparatus embodying the present invention.

Referring to FIG. 1 of the drawings, an image forming apparatus embodying the present invention is shown and includes a photoconductive element implemented as a drum 1. A charging device 2, an exposing device (optics for exposure) 3, a developing device 4, a transfer belt 5, a cleaning device 6 including a cleaning blade 6*a* and a discharge lamp 7 are 5 sequentially arranged around the drum 1 in this order.

The drum 1 is rotatable counterclockwise, as viewed in FIG. 1. A registration roller pair 8 is positioned upstream of the transfer belt 5 in the direction of rotation of the drum 1. The charging device 2 is made up of a charge roller 21 and a roller cleaning member 22. The charge roller 21 is driven by the drum 1 when the drum 1 is rotated. The roller cleaning member 22 is held in contact with the charge roller 21 for removing toner, paper dust and other impurities from the surface of the charge roller 21. The charge roller 21 is supported by bearings at both ends thereof and pressed against the drum 1 by a spring, not shown. In this condition, the charge roller 21 is driven by the drum 1 due to friction acting therebetween. A support mechanism, 24, causes the roller cleaning member 22 to move in the lengthwise direction of the charge roller 21.

In operation, the charge roller 21 uniformly charges the surface of the drum 1 in rotation. The exposing device 3 exposes the charged surface of the drum 1 imagewise in order to form a latent image thereon. The developing device 4 develops the latent image with toner to thereby produce a corresponding toner image. The registration roller pair 8 feeds a paper or similar recording medium to the transfer belt 5 such that the leading edge of the paper meets the leading edge of the toner image. The transfer belt 5 transfers the toner image from the drum 1 to the paper. The cleaning device 6 removes the toner left on the drum 1 after the image transfer. The discharge lamp 7 dissipates charge also left on the drum 1 so as to prepare the drum 1 for the next image forming cycle.

Although most of the toner left on the drum 1 is scraped off by the cleaning device 6, a small amount of toner is left on the drum 1 and moved away from the cleaning device 6. This part of the toner deposits on the charge roller 21. The roller cleaning member 22 removes such toner from the charge roller 21 together with paper dust and other impurities. In the illustrative embodiment, the roller cleaning member 22 is formed of sponge, i.e., porous elastic foam material. For example, use may advantageously be made of SM55 (trade name) porous elastic foam available from Inoac Corporation or HR50 (trade name) porous elastic foam available from Bridgestone Corp.

Figure 2:
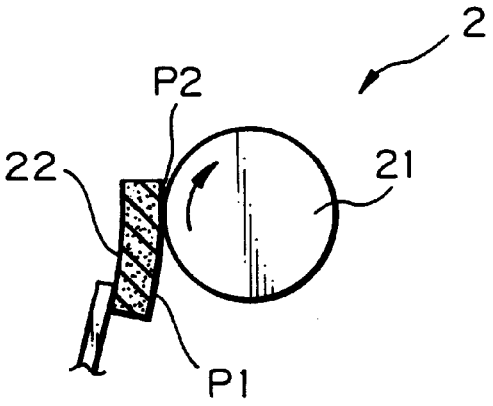
FIG. 2 shows a point where a roller cleaning member included in the embodiment is supported and a point where it contacts a charge roller also included in the embodiment.

As shown in FIG. 2, the roller cleaning member 22 is fixedly supported with respect to the axis of rotation of the charge roller 21 at a point P1 and held in contact with the charge roller 21 at a point P2. The point P1 is located upstream of the point P2 in the direction of rotation of the charge roller 21. In this condition, the pressure acting on the drum 1 is successfully reduced due to a moment around the fulcrum and derived from a frictional force occurring while the charge roller 21 is in rotation. As a result, the tolerable width of pressure (compression) in a standstill condition can be increased.

A relatively great frictional force acts between the charge roller 21 and roller cleaning member which are formed of elastic materials. Therefore, without the configuration shown in FIG. 2, the pressure (compression) in a standstill condition would have to be set with utmost accuracy.

Figure 3:
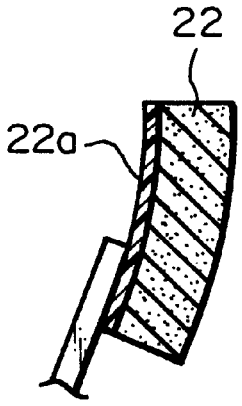
FIG. 3 is an enlarged view of the roller cleaning member.

As shown in FIG. 3, an elastic member 22*a* is fitted on the side of the roller cleaning member 22 opposite to the side contacting the charge roller 21 in order to enhance the cleaning effect of the cleaning member 22. The elastic member 22*a* is implemented by, e.g., a polyester film and affixed to the roller cleaning member 22 by, e.g., a two-sided adhesive tape. The elastic member 22*a* provides the free end of the roller cleaning member 22 with some degree of elasticity. The roller cleaning member 22 therefore exerts a constant preselected pressure when brought into contact with the charge roller 21.

When the elastic member 22*a* adhered to the roller cleaning member 22 is implemented by a polyester film, its thickness should preferably be 50 $\mu$m to 100 $\mu$m. Thicknesses less than 50 $\mu$m would fail to enhance the cleaning ability of the roller cleaning member 22. Thicknesses greater than 100 lam would provide the roller cleaning member 22 with excessive elasticity and would thereby cause filming to occur on the charge roller 21 in a short period of time.

Generally, when the drum 1 is brought to a stop, it is rotated in the reverse direction by about 10 mm in order to prevent the cleaning blade 6*a* of the cleaning device 6 from biting impurities and bringing about defective cleaning. At this instant, the charge roller 21 is also rotated in the reverse direction because the roller 21 is driven by friction acting between roller 21 and the drum 1. As a result, the charge roller 21 is apt to drag the roller cleaning member 22. The elastic member 22*a* fitted on the roller cleaning member 22 and providing the member 22*a* with some degree of elasticity is also effective to prevent the member 22 from being dragged by the charge roller 21.

Even in the above configuration, filming sometimes occurs on the charge roller 21 after a long time of operation. When a DC voltage for charging is applied to the charge roller 21, the filming translates into a drop of charge potential. Specifically, the filming forms, as it were, a thin layer of high resistance on the surface of the charge roller 21 and apparently increases the resistance of the roller 21, thereby lowering the charging efficiency.

Figure 4:
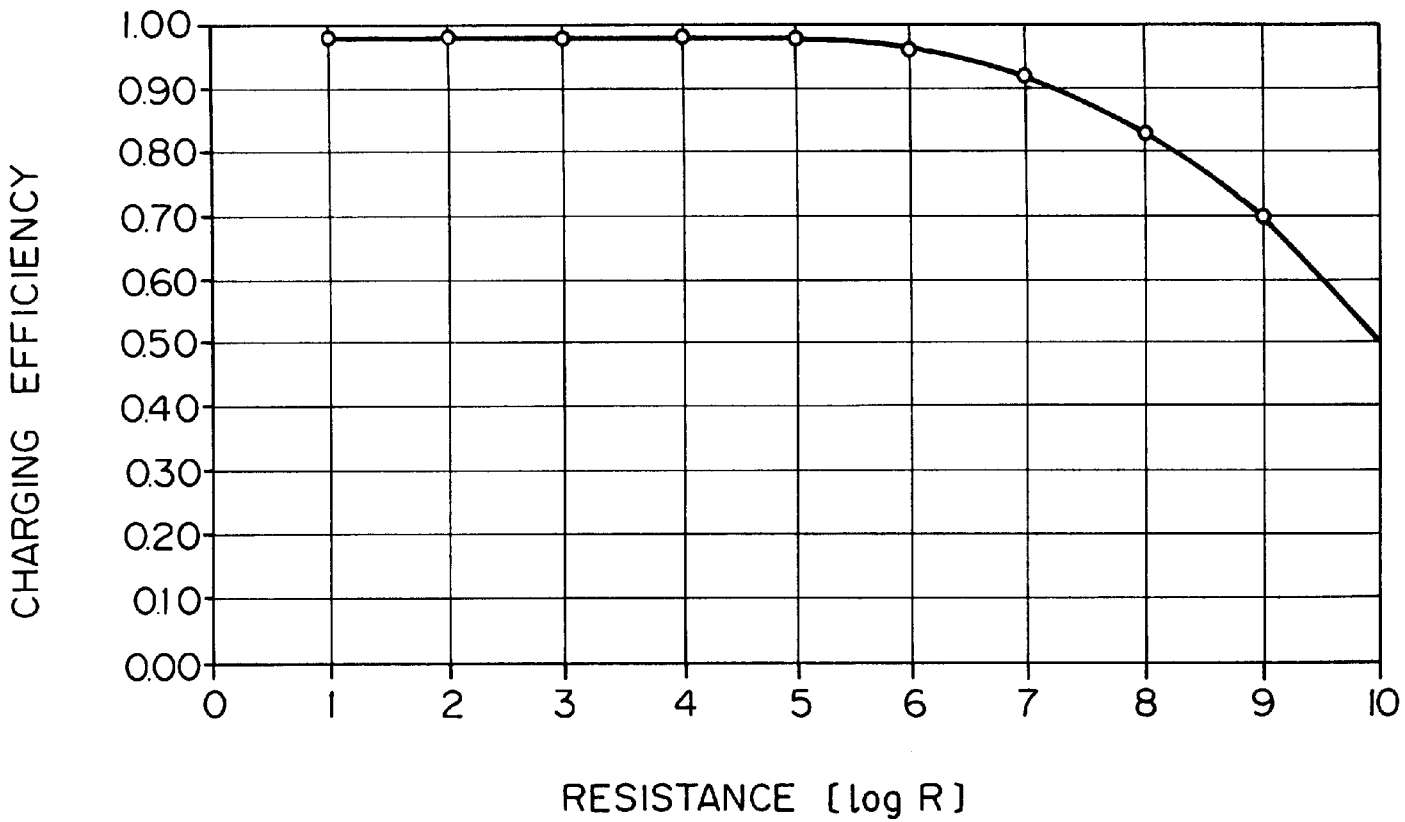
FIG. 4 is a graph showing a relation between the resistance of the charge roller and the charging efficiency.

FIG. 4 shows a relation between the resistance of the charge roller 21 and the charging efficiency. In the configuration of the illustrative embodiment, the resistance of the charge roller 21 was sequentially varied in order to determine how the charge potential drops. A DC constant voltage of −1.6 kV was applied to the roller 21. When the resistance of the roller 21 was about $1\times10^{8}\Omega$, a potential drop of about 200 V occurred when 20,000 papers were passed. By contrast, when the resistance of the roller 21 was about $1\times10^{7}\Omega$, a potential drop of only about 80 V occurred when even 200,000 papers were passed. When the resistance of the roller 21 was less than $1\times10^{3}\Omega$ inclusive, the potential locally dropped due to an overcurrent flown through the pin holes of the drum 1.

Usually, the resistance of the charge roller 21 is selected to be less than $1\times10^{9}\Omega$ inclusive for obviating potential drop and other undesirable occurrences, as taught in Japanese Patent Laid-Open Publication No. 5-173400. On the other hand, in the cleaning system of the type having a cleaning member constantly contacting the charge roller 21, even the potential drop ascribable to the filming on the roller 21 can be obviated if the resistance of the roller 21 is selected to be less than $1\times10^{7}\Omega$ inclusive, taking account of the apparent increase in roller resistance mentioned earlier.

Figure 5:
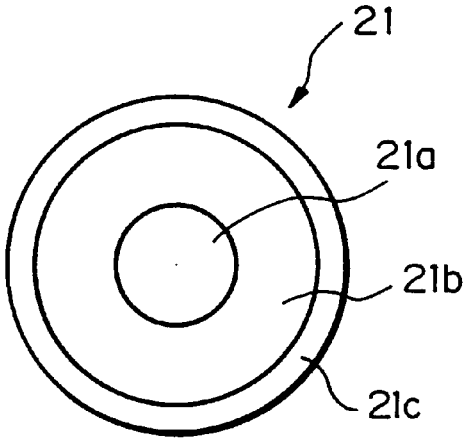
FIG. 5 is a view showing a specific configuration of the charge roller.

As shown in FIG. 5, in the illustrative embodiment, the charge roller 21 is made up of a metallic core 21*a*, an elastic layer 21*b* covering the core 21*a*, and a surface layer 21*c* covering the elastic layer 21*b*. The core 21*a* is formed of SUS 303 and provided with a diameter of 8 mm. The elastic layer 21*b* is 3 mm thick and formed of epichlorohydrin rubber. The elastic layer 21*c* is 5 $\mu$m thick and formed of nylon with 10 wt % of carbon dispersed therein.

When the charge roller 21 having the configuration shown in FIG. 5 was applied with a DC constant voltage, the charging efficiency fell little when even 200,000 papers were passed. The charge roller 21 has a resistance of about $5\times10^{4}\Omega$ to about $5\times10^{6}\Omega$ in a 10° C., 15% atmosphere to a 30° C., 90% atmosphere.

The surface of the charge roller 21 was analyzed after a long time of operation. The analysis showed that silica added to toner deposited on the roller 21 in a great amount. The toner applied to the illustrative embodiment is made up of a binding resin implemented by a polyester and styrene-acryl copolymer, a pigment implemented by carbon black, a charge control agent implemented by a chromium-containing dye, and a fluidity control additive implemented by silica. The silica content of the toner is 0.1 wt %.

For confirmation, when the content of silica of the above toner was increased to 1.5 wt %, the charge potential dropped by about 50 V with the charge roller 21 shown in FIG. 5 when 20,000 papers were passed; many smears in the form of stripes appeared on the surface of the roller 21. When the silica content was reduced to 0.5 wt %, the charge potential dropped by only about 30 V when 20,000 papers were passed; no smears appeared on the roller 21.

In summary, in accordance with the present invention, an image forming apparatus includes a charge roller whose resistance ranges from $1\times10^{3}\Omega$ to $1\times10^{7}\Omega$. This reduces the amount of fall of charge potential despite filming which may occur on the charge roller. The charge roller can therefore exhibit a stable charging ability over a long period of time, ensuring high quality images. Because a sophisticated mechanism for, e.g., moving the charge roller or a roller cleaning member is not necessary, the apparatus is simple in construction and low cost.

Further, despite that the roller cleaning member is constantly held in contact with the charge roller, a minimum of filming is allowed to occur on the charge roller. This also ensures stable image quality over a long period of time. In addition, cleaning conditions can be selected with ease.

Various modifications will become possible for those skilled in the art after receiving the teachings of the present disclosure without departing from the scope thereof.

What is claimed is:

1. An image forming apparatus using a roller type charging system, comprising:

a charge roller rotated by a photoconductive element while contacting at least an image forming region of said photoconductive element; and elastic cleaning means contacting said charge roller for removing impurities, including toner, from a surface of said charge roller, said elastic cleaning means being fixedly supported with respect to an axis of rotation of said charge roller at a point upstream of a point where said elastic cleaning means contacts said charge roller in a direction of rotation of said charge roller;

said charge roller having a resistance ranging from about $1\times10^3\Omega$ to about $1\times10^7\Omega$.

2. An apparatus as claimed in claim 1, wherein said elastic cleaning means is formed of a porous elastic foam material.

3. An apparatus as claimed in claim 2, further comprising a support mechanism for causing said elastic cleaning means to move in a lengthwise direction of said charge roller.

4. An apparatus as claimed in claim 2, wherein the elastic cleaning means comprises an elastic member for maintaining a substantially constant pressure between the porous elastic foam material and the charge roller.

5. An apparatus as claimed in claim 4, wherein the elastic member comprises a polyester film affixed to the porous elastic foam material.

6. An apparatus as claimed in claim 6, wherein the polyester film has a thickness of about 50 $\mu$m to about 100 $\mu$m.

7. An image forming apparatus using a roller type charging system, comprising:

a charge roller rotated by a photoconductive element while contacting at least an image forming region of said photoconductive element; and elastic cleaning means contacting said charge roller for removing impurities, including a toner, from a surface of said charge roller, said elastic cleaning means being fixedly supported with respect to an axis of rotation of said charge roller at a point upstream of a point where said elastic cleaning means contacts said charge roller in a direction of rotation of said charge roller;

wherein said toner comprises about 1 wt % of a fluid control additive.

8. An apparatus as claimed in claim 7, wherein said elastic cleaning means is formed of a porous elastic foam material.

9. An apparatus as claimed in claim 8, further comprising a support mechanism for causing said elastic cleaning means to move in a lengthwise direction of said charge roller.

10. An apparatus as claimed in claim 8, wherein the elastic cleaning means comprises an elastic member for maintaining a substantially constant pressure between the porous elastic foam material and the charge roller.

11. An apparatus as claimed in claim 10, wherein the elastic member comprises a polyester film affixed to the porous elastic foam material.

12. An apparatus as claimed in claim 11, wherein the polyester film has a thickness of about 50 $\mu$m to about 100 $\mu$m.

* * * * *